US007010397B1

(12) United States Patent
Pfleging et al.

(10) Patent No.: US 7,010,397 B1
(45) Date of Patent: Mar. 7, 2006

(54) UTILIZATION BY A VEHICLE OF WIRELESS DATA FROM INTELLIGENT STREET SIGNS

(75) Inventors: Gerald W. Pfleging, Batavia, IL (US); Rachel M. Pfleging, Batavia, IL (US); George P. Wilkin, Bolingbrook, IL (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 11/136,820

(22) Filed: May 25, 2005

(51) Int. Cl.
*G08B 3/00* (2006.01)

(52) U.S. Cl. ..... 701/1; 701/36; 701/200; 340/691.6

(58) Field of Classification Search ..... 701/1, 701/24, 25, 36, 117, 200–213; 340/902, 340/928, 933, 988, 691.1, 691.6
See application file for complete search history.

(56) References Cited

U.S. PATENT DOCUMENTS

| | | | | |
|---|---|---|---|---|
| 6,587,755 | B1 * | 7/2003 | Smith et al. | 701/1 |
| 6,690,286 | B1 * | 2/2004 | Polyakov | 340/691.6 |
| 6,807,464 | B1 * | 10/2004 | Yu et al. | 701/1 |
| 6,885,935 | B1 * | 4/2005 | MacPhail et al. | 701/117 |
| 6,922,138 | B1 * | 7/2005 | Melvin | 340/438 |

* cited by examiner

*Primary Examiner*—Richard M. Camby

(57) ABSTRACT

An exemplary vehicular apparatus includes a radio frequency receiver adapted for receipt of signals transmitted from intelligent street sins. A computer receives recovered digital data from the receiver, where the digital data represents information contained in the signals received by the receiver. The computer parses the digital data into separate fields and identifies a first field containing a first value that represents a predetermined type of vehicle for which the information contained in the other fields is relevant. The computer compares the first value with a stored value in memory to determine if the information contained in the other fields is relevant to the vehicle and recovers the information contained in the other fields if it is determined that the other fields are relevant to the vehicle.

15 Claims, 1 Drawing Sheet

UTILIZATION BY A VEHICLE OF WIRELESS DATA FROM INTELLIGENT STREET SIGNS

BACKGROUND

This invention relates to the wireless transmission of data associated with vehicular transportation and more specifically relates to interpreting such data by a vehicle.

Advances in technology along with lower costs are giving rise to new opportunities for new or improved communications. For example, wireless cellular communications are supported in most metropolitan cities around the world. In addition to voice communications, many of such cellular systems also support text messaging. Internet access utilizing a laptop computer or a personal digital assistant makes data communications possible from a variety of wireless (WI-FI) hot spots such as at hotels, airports, coffee shops, etc. The proliferation of such technologies results in efficiencies in manufacturing and lower costs of production.

Global positioning satellite (GPS) receivers are available as stand-alone portable units as well as vehicular mounted units. As long as the GPS receiver can receive acceptable signals, location information can be accurately conveyed to the user such as a driver of a vehicle. Available GPS systems can show the current location of a vehicle on a displayed map of the area and can provide route instructions for getting to a specified destination.

Despite such advances in communications, only limited data communication systems have been developed to provide information concerning conditions or events relevant to a driver and/or vehicle over the course of a journey of the vehicle. In one known system transmitters having a limited range of only a few hundred feet were deployed along a bus route. The transmitters transmitted data information by which each route marker was uniquely identified. The buses were provided with a data receiver to receive these transmissions. A separate conventional two-way radio was coupled to the data receiver in the buses which allowed the received data to be transmitted to a bus control center so that the position of the buses could be accurately monitored over the course of the bus route. This facilitated the management of a fleet of buses in a city. In another system a wireless transponder mounted in a car communicates with a communication device located at highway toll plazas facilitates the payment of tolls without requiring the car to come to a stop at the plaza. Although such data communication systems have proved useful, there exists a need to provide and utilize additional information related to the journey of a vehicle relating to conditions or events along the journey.

SUMMARY

It is an object of the present invention to satisfy this need.

An exemplary vehicular apparatus includes a radio frequency receiver adapted for receipt of signals transmitted from intelligent street signs. A computer receives recovered digital data from the receiver, where the digital data represents information contained in the signals received by the receiver. The computer parses the digital data into separate fields and identifies a first field containing a first value that represents a predetermined type of vehicle for which the information contained in the other fields is relevant. The computer compares the first value with a stored value in memory to determine if the information contained in the other fields is relevant to the vehicle and recovers the information contained in the other fields if it is determined that the other fields are relevant to the vehicle.

The present invention also encompasses an exemplary system that includes intelligent street signs and vehicles that can benefit therefrom, as well as an exemplary method for implementing such vehicular assistance.

DESCRIPTION OF THE DRAWINGS

Features of exemplary implementations of the invention will become apparent from the description, the claims, and the accompanying drawings in which:

DETAILED DESCRIPTION

One aspect of the present invention resides in the recognition of the difficulties associated with determining whether received data from an intelligent street sign is relevant to a particular vehicle, and if so, how it is relevant. This aspect is complicated by the desire to have vehicles only need a receiver to receive street sign data as contrasted with the vehicle also being capable of transmitting information to intelligent street signs.

Figure 1:
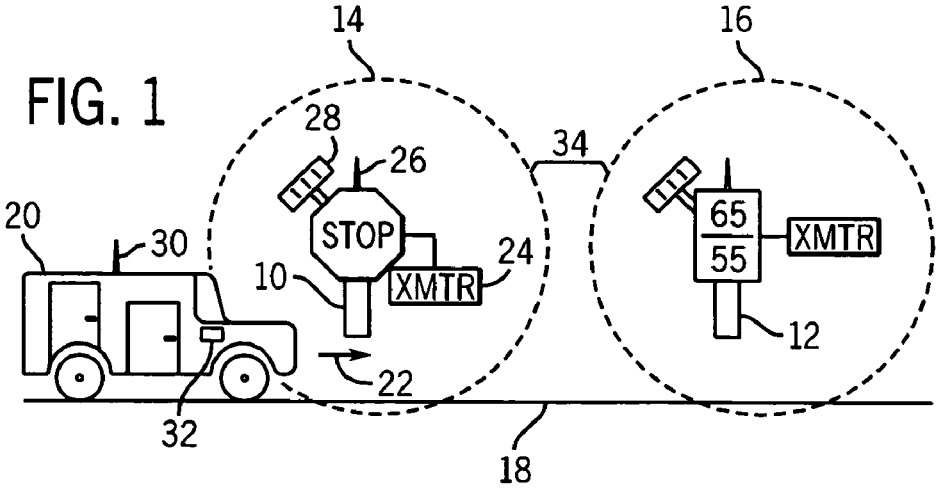
FIG. 1 is a block diagram of an intelligent street sign environment and a vehicle suited for implementing an embodiment of the present invention.

FIG. 1 shows exemplary intelligent stop street sign 10 and speed limit street sign 12 each capable of transmitting a wireless signal that can be received within areas 14 and 16, respectively. The street signs are disposed along a road 18 which an exemplary vehicle 20 is traveling in the direction as indicated by arrow 22.

The intelligent stop street sign 10 includes a transmitter 24 connected to an antenna 26 for radiating a signal having an effective area 14. A power source, such as a solar panel, 28 coupled with a storage battery provides a source of power for transmitter 24 enabling it to transmit continuously. The transmitter 24 preferably includes nonvolatile memory that stores data that is repetitively transmitted. The type of information transmitted and the communications protocol utilized are discussed below. The intelligent speed limit street sign 12 has substantially similar elements to street sign 10 but of course transmits different data.

Vehicle 20 which may for example comprise a car or truck utilizes an antenna 30 coupled to a communication apparatus 32 configured for reception and processing of the signals transmitted by intelligent street signs. As shown in FIG. 1, vehicle 20 is just entering the area 14 in which the signal transmitted by the intelligent stop sign 10 can be received. As vehicle 20 travels in the direction as indicated by arrow 22, it will pass through area 14, enter a region 34 in which no intelligent street sign signal is present, and enter area 16 in which the signal from intelligent speed limit street sign 12 is present. Thus, the vehicle 20 will receive the signal from sign 10 while in area 14 and will receive the signal from sign 12 while in area 16. In the illustrative example, areas 14 and 16 do not overlap so that a region 34 exists in which no street sign signal will be received by vehicle 20. However, street signs can be disposed such that overlapping coverage areas exist.

Figure 2:
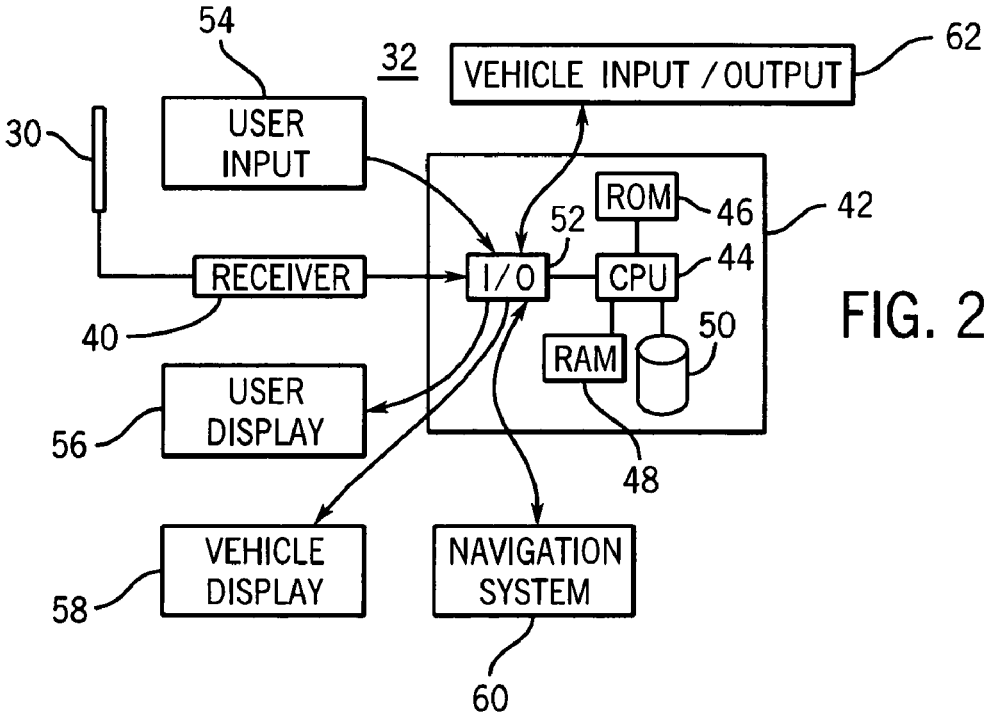
FIG. 2 is a block diagram of an exemplary apparatus disposed in a vehicle

FIG. 2 illustrates an exemplary communication apparatus 32 in which antenna 30 couples received signals to radio frequency (RF) receiver 40. A computer 42 includes a central processing unit (microprocessor) 44 that is supported by read-only memory (ROM) 46, random access memory (RAM) 48 and nonvolatile data storage element 50 that may comprise a hard drive. As will be understood by those skilled in the art, ROM 46 and/or data storage 50 will contain program control instructions that will be typically transferred at least in part to RAM 48 for operation and control of the computing functions implemented by computer 42. An input/output (I/O) module 52 is coupled to CPU 44 and supports communications with external elements, i.e. the receipt of incoming data to computer 42 and the transmission of outgoing data from computer 42.

The receiver 40 receives the RF signals transmitted from the intelligent street signs and demodulates the received RF signals into binary data that is transmitted to the I/O module 52. This binary data is processed by CPU 44 in accordance with stored program instructions to parse the binary data into predetermined fields or binary bytes. The information (values) contained in the binary bytes is compared against values stored in computer 42 in order to determine what information has been conveyed. A further discussion of the communication protocol and the significance of data in predetermined fields are provided below in association with FIG. 3.

A user input device 54 such as a keyboard, mouse or touch screen provides a means for inputting user information and commands to computer 42. A user display 56 such as an LCD screen provides a means for displaying information to the user. A vehicle display 58 such as a vehicle dashboard display module provides a further means for displaying information to the user. An exemplary navigation system 60 such as a GPS system is capable of providing location related information to and receiving location related information from computer 42. A vehicle input/output module 62 provides an interface by which the computer 42 can receive information generated by the vehicle's electronic system, e.g. the speed of the vehicle, and can transmit control signals to the vehicle's electronic system, e.g. turn-on headlights, blow the horn, etc. It will be apparent that these are merely examples of the various inputs and controls that can be utilized depending upon the desired application. Examples of the operation of computer 42 in conjunction with the peripheral devices are provided below.

Figure 3:
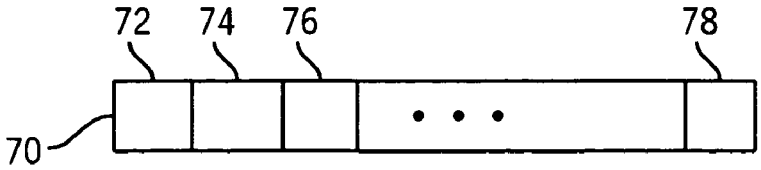
FIG. 3 is diagram showing an illustrative communication format for the reception of data by a vehicle from an intelligent street sign in accordance with the present invention.

FIG. 3 shows an illustrative communication protocol in which a series of binary bytes form a packet 70 that is decoded by receiver 40 and transmitted to computer 42 for interpretation. The packet 70 is divided into a plurality of fields where each field may contain a value that can be correlated into corresponding information by the computer 42 by comparing the values in the fields to predetermined value stored in the computer associated with corresponding information. For example, field 72 may contain a value that defines the number of fields or bytes contained in packet 70. Field 74 may contain a value that identifies the type or types of vehicles for which the information is relevant. For example values of 1, 2, 3 or 4 in field 74 may correspond to all vehicles, cars, trucks under a specified weight and trucks over a specified weight, respectively. It will be understood that various additional or alternate values could be utilized for field 74 in order to distinguish information intended for only certain vehicles or types of vehicles. The use of such a field 74 enables computer 42 to easily and quickly determine if a received packet contains information in additional fields that is relevant to the vehicle containing the computer. For example, if field 74 identifies the packet as being only relevant to trucks over a specified weight, then the computer need not decode the remainder of the fields where the computer is in a car. The remaining fields including fields 76 and 78 will contain values that correspond to related information associated with the intelligent street sign. For example, one the fields can contain a value representing for which direction of travel of a vehicle the sign information is relevant. That is, a "sharp left curve ahead" sign posted before the curve would only be relevant for vehicles approaching the curve, not vehicles traveling in the other direction that will have already gone through the subject curve. This direction value could be compass based, e.g. a value of "180" would indicate it is relevant for vehicles traveling substantially South (180), but not for vehicles traveling North (0 or 360). This of course requires the computer of the vehicle to know its direction of travel which can be determined by navigation information.

In addition to information related to the control or regulation of vehicles, the intelligent street signs may store and transmit location information of the street sign that can be contained within packet 70. This provides vehicles with at least periodic geographic location information. Time and/or date information may also be contained within these fields where such information is relevant to traffic control. For example, speed zones adjacent schools are often only in force during times when school is in session. Some traffic control signs are only relevant during specific time periods, e.g. "no left turn from 4–6 p.m." Thus, such predetermined time and/or date information can be compared with the current time and/or date as determined by computer 42 to determine whether the traffic control information and/or restrictions currently apply.

In order for the computer 42 to make determinations and comparisons, the user will need to input certain information into the computer that can be stored for later use. For example, it is preferable that the computer generate a start up set of questions or menus that will guide the user through the inputting of the required information. For example, the user can be requested to input the type of vehicle in which the computer is disposed or to select a type of vehicle from a displayed list. Depending upon the specific vehicle, additional information or selections may be required, e.g. choosing a weight class for a truck, the number of axles of the vehicle, height of the vehicle, etc. If the computer 42 is also to be utilized for navigation over the course of a trip, the user may be requested to enter a current location, intermediate points along a route and a final destination so that location information received along the route from the intelligent street signs can be utilized to determine the current location of the vehicle relative to the intended route. Depending upon whether the computer has access to the other time/date information sources, the user may also be requested to enter the current time and date. The information sought from the user may be conveyed by the user display 56. User input 54 can be utilized to input the requested information that can be stored in nonvolatile a storage element 50 for subsequent use. Alternatively, such user input can be entered and locked to prevent unauthorized changes from being made.

Various uses exist for the information received from the intelligent street signs. One straightforward use is to simply display the information to the user via the user display 56 or the vehicle display 58. For example, as the vehicle enters area 14 indicating that the vehicle is approaching the intelligent stop street sign, the word "STOP" or the symbol for a stop sign could be displayed.

Assuming that the speed of the vehicle is available to computer 42 from module 62, an alert may be provided to the driver if the speed of the vehicle is not being reduced at a sufficient rate after entering area 14. For example, the alert may consist of displaying a large flashing stop sign symbol and/or providing an audible alert, e.g. sounding the horn. While the vehicle is within area 16, the applicable speed limit can be displayed and an alert can be provided to the driver if the current speed of the vehicle exceeds the speed limit or exceeds the speed limit by a predetermined percentage.

The data received from intelligent street signs can be utilized to interact with or control other car systems if desired. For example, upon receiving a packet from a street sign containing information indicating the entrance to a tunnel, the computer could automatically generate a command that would be transmitted to module 62 to cause the vehicle's headlights, if not already on, to be turned on. Upon receiving a packet from a street sign indicating that the vehicle is entering a quiet zone, the computer could automatically generate a command that would cause the sound level of the horn, if activated, to be at a reduced level. The vehicle's cruise control setting could be automatically changed upon entering a new reduced speed limit zone as determined by the receipt of a packet from a speed limit street sign. Based on the information received from intelligent street signs, a variety of actions or events associated with the operation of the vehicle could be automatically taken. Of course, safety of the driver and passengers remain paramount and hence some actions that could be automatically taken may be inappropriate if safety is adversely impacted.

Even if a navigation system module 60 is present, location information derived from intelligent street signs can be utilized to augment the information generated by module 60. The vehicle may be in a location in which the GPS receiver of module 60 is unable to receive sufficient GPS signals to determine a current location. For example, while the vehicle is in a tunnel, location information received from an intelligent road sign can be utilized to confirm the location of the vehicle.

Although exemplary implementations of the invention have been depicted and described in detail herein, it will be apparent to those skilled in the art that various modifications, additions, substitutions, and the like can be made without departing from the spirit of the invention. For example, various types of RF communications could be utilized to carry the intelligent street sign information such as IEEE 802.11, 806.16 or 3G wireless communications. Receivers and transmitters for implementing such wireless communications are available. Actions such as automatically braking upon approaching a stop sign at too great a speed could be implemented assuming that it is determined that this would be in the best interest of safety for the occupants of the vehicle as well as others.

The scope of the invention is defined in the following claims.

We claim:

1. An apparatus adapted for use in a vehicle comprising:

a radio frequency receiver adapted for receipt of signals transmitted from intelligent street signs;

a computer, coupled to the receiver, receives a packet of digital data from the receiver, where the digital data represents information contained in the signals received by the receiver;

the computer parses the digital data into separate fields where each field contains values representing information related to the corresponding street sign;

the computer identifying a first field containing a first value where the first value defines a predetermined type of vehicle for which the information contained in the other fields is relevant;

the computer comparing the first value with a stored value in memory of the computer to determine if the information contained in the other fields is relevant to the vehicle;

the computer recovering the information contained in the other fields if the comparison of the first value with the stored value determined the other fields to be relevant to the vehicle.

2. The apparatus of claim 1 further comprising:

the computer identifying another field containing another value where the another value represents at least one time interval where the at least one time interval is associated with another parameter of the intelligent street sign transmitted as part of the digital data;

the computer comparing the another value with a current date and time;

a computer generating a signal corresponding to an action relevant to the another parameter if the comparison shows that the current date and time is within the at least one time interval.

3. The apparatus of claim 1 further comprising:

a display coupled to the computer and adapted to display visual information to a driver of the vehicle;

the computer transmitting an output signal to the display where the output signal causes the display to show indicia corresponding to a value received in one of the other fields.

4. The apparatus of claim 1 further comprising:

a navigation system coupled to the computer;

the computer identifying another field containing another value where the another value represents location information defining the location of the intelligent street sign from which the packet of digital data was received, the computer transmitting the location information contained in the another field to the navigation system for use by the latter.

5. The apparatus of claim 1 further comprising:

a vehicle input/output module coupled to the computer;

the computer generating and transmitting a signal to the vehicle input/output module, the signal corresponding to an action relevant to another parameter received as part of the digital data from the intelligent street sign.

6. A system for providing and utilizing information wirelessly provided to a vehicle during a journey comprising:

a plurality of intelligent street signs disposed adjacent a roadway for vehicular traffic, each intelligent street sign including a wireless transmitter that repetitively transmits radio frequency signals that carry digital data where at least part of the digital data contains information associated with the function of the intelligent street sign;

a radio frequency receiver disposed in a vehicle and adapted for receipt of the radio frequency signals transmitted from the intelligent street sign;

a computer, coupled to the receiver and disposed in the vehicle, receives the digital data recovered by the receiver;

the computer parses the digital data into separate fields where each field contains values representing information related to the corresponding street sign;

the computer identifies a first field containing a first value where the first value defines a predetermined type of vehicle for which the information contained in the other fields is relevant;

the computer compares the first value with a stored value in memory of the computer to determine if the information contained in the other fields is relevant to the vehicle;

the computer recovering the information contained in the other fields if the comparison of the first value with the stored value determined the other fields to be relevant to the vehicle.

7. The system of claim 6 further comprising:

the computer identifying another field containing another value where the another value represents at least one time interval where the at least one time interval is associated with another parameter of the intelligent street sign transmitted as part of the digital data;

the computer comparing the another value with a current date and time;

a computer generating a signal corresponding to an action relevant to the another parameter if the comparison shows that the current date and time is within the at least one time interval.

8. The system of claim 6 further comprising:

a display coupled to the computer and adapted to display visual information to a driver of the vehicle;

the computer transmitting an output signal to the display where the output signal causes the display to show indicia corresponding to a value received in one of the other fields.

9. The system of claim 6 further comprising:

a navigation system coupled to the computer;

the computer identifying another field containing another value where the another value represents location information defining the location of the intelligent street sign from which the packet of digital data was received, the computer transmitting the location information contained in the another field to the navigation system for use by the latter.

10. The system of claim 6 further comprising:

a vehicle input/output module coupled to the computer;

the computer generating and transmitting a signal to the vehicle input/output module, the signal corresponding to an action relevant to another parameter received as part of the digital data from the intelligent street sign.

11. A method for acquiring information useful for assisting a vehicle along a journey comprising the steps of:

receiving radio frequency signals transmitted from intelligent street signs by a receiver disposed in the vehicle;

receiving a packet of digital data recovered by the receiver from the received signals by a computer disposed in the vehicle;

parsing the digital data into separate fields by the computer where each field contains values representing information related to the corresponding street sign;

identifying a first field containing a first value by the computer where the first value defines a predetermined type of vehicle for which the information contained in the other fields is relevant;

comparing the first value with a stored value in memory of the computer to determine if the information contained in the other fields is relevant to the vehicle;

recovering the information contained in the other fields if the comparison of the first value with the stored value determined the other fields to be relevant to the vehicle.

12. The method of claim 11 further comprising:

identifying another field containing another value where the another value represents at least one time interval where the at least one time interval is associated with another parameter of the intelligent street sign transmitted as part of the digital data;

comparing the another value with a current date and time;

generating a signal corresponding to an action relevant to the another parameter if the comparison shows that the current date and time is within the at least one time interval.

13. The method of claim 11 further comprising:

displaying visual information to a driver of the vehicle via a display;

transmitting an output signal to the display from the computer where the output signal causes the display to show indicia corresponding to a value received in one of the other fields.

14. The method of claim 11 further comprising:

coupling a navigation system disposed in the vehicle to the computer;

identifying another field containing another value by the computer where the another value represents location information defining the location of the intelligent street sign from which the packet of digital data was received, transmitting the location information contained in the another field from the computer to the navigation system for use by the latter.

15. The method of claim 11 further comprising:

coupling a vehicle input/output module disposed in the vehicle to the computer;

generating and transmitting a signal to the vehicle input/output module from the computer, the signal corresponding to an action relevant to another parameter received as part of the digital data from the intelligent street sign.

* * * * *

UNITED STATES PATENT AND TRADEMARK OFFICE

CERTIFICATE OF CORRECTION

PATENT NO. : 7,010,397 B1
APPLICATION NO. : 11/136820
DATED : March 7, 2006
INVENTOR(S) : Pfleging et al.

It is certified that error appears in the above-identified patent and that said Letters Patent is hereby corrected as shown below:

Title page, Col. 2, line 3;

In the Abstract:

At the end of the first sentence of the Abstract, please delete the word "sins."

and replace with the word --sings.--

Signed and Sealed this

Twenty-second Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 7,010,397 B1
APPLICATION NO. : 11/136820
DATED : March 7, 2006
INVENTOR(S) : Pfleging et al.

It is certified that error appears in the above-identified patent and that said Letters Patent is hereby corrected as shown below:

Title Page Line 3; In the Abstract:

At the end of the the first sentence of the Abstract, please delete the word "sings." and replace with the word --signs.--

Signed and Sealed this

Twenty-eighth Day of November, 2006

JON W. DUDAS
*Director of the United States Patent and Trademark Office*